US006076464A

United States Patent [19]

Okamura

[11] Patent Number: 6,076,464

[45] Date of Patent: Jun. 20, 2000

[54] SYSTEM FOR MAKING PRINTING PLATES FOR NEWSPAPER PRINTING

[75] Inventor: Yuichi Okamura, Osaka-fu, Japan

[73] Assignee: Kabushiki Kaisha Kaneda Kikai Seisakusho, Osaka, Japan

[21] Appl. No.: 09/386,364

[22] Filed: Aug. 31, 1999

[30] Foreign Application Priority Data

Sep. 9, 1998 [JP] Japan ..... 10-254928

[51] Int. Cl.[7] ..... B41L 47/14

[52] U.S. Cl. ..... 101/401.1; 101/463.1; 101/477; 29/563; 29/33 H; 29/33 P; 72/324; 72/338

[58] Field of Search ..... 101/401.1, 463.1, 101/477, 486, DIG. 36; 29/33 H, 33 P, 34 R, 564, 563; 72/319, 324, 338, 341

[56] References Cited

U.S. PATENT DOCUMENTS

| | | | |
|---|---|---|---|
| 3,735,627 | 5/1973 | Eburn, Jr. | 72/324 |
| 5,205,039 | 4/1993 | Ternes | 29/895.21 |
| 5,257,444 | 11/1993 | Nishiyama | 29/33 H |
| 5,701,170 | 12/1997 | Powers et al. | 101/463.1 |
| 5,887,525 | 3/1999 | Okamura et al. | 101/401.1 |
| 5,967,048 | 10/1999 | Fromson et al. | 101/463.1 |
| 5,987,949 | 11/1999 | Palmatier et al. | 72/306 |

*Primary Examiner*—John S. Hilten
*Assistant Examiner*—Leslie J. Grohusky
*Attorney, Agent, or Firm*—Griffin & Szipl, P.C.

[57] ABSTRACT

A system for making printing plates for newspaper, which can make, with great efficiency, replacement printing plates to be used when a printing face of the printing plate mounted on the plate cylinder of the rotary press is to be changed in part. The plate-making system is built by linearly arranging in series a plate feeder 2, an exposure unit 3, and a developer 5 so that the exposure unit 3 may directly form images on the printing faces of a plate material 12 in accordance with image drawing signals from a computer to make a printing plate P large enough for at least several pages. On the downstream side of the developer 5 are provided: a borer 7 for making positioning notches 12*a* and positioning holes 12*b* in the plate material 12 (for several pages of newspaper) as discharged from the developer 5; a cutter 12 for cutting the plate material 12 (for several pages of newspaper) from the borer 7 into several plate materials 12', each the size one page of newspaper; a first bender for forming bends 12*c*, for mounting the printing plate on the rotary press, in the plate material 12 (for several pages of newspaper) which plate material has not been cut by the cutter 8 after being bored by the borer 7; and a second bender for forming bends 12*c*, for mounting the printing plate on the rotary press, in several one page size plate materials 12' which have been obtained by cutting the plate material 12 by the cutter 8 after boring by the borer 7.

4 Claims, 9 Drawing Sheets

SYSTEM FOR MAKING PRINTING PLATES FOR NEWSPAPER PRINTING

BACKGROUND OF THE INVENTION

1. Field of the Invention

The present invention relates to an improved system for making printing plates for newspaper printing by a computerized direct laser drawing technique.

2. Description of the Prior Art

The recent progress of computer information and image processing technologies has found its way into such fields as newspaper printing, too, bringing about development of a system for making printing plates for newspaper printing by the so-called computer to plate (CTP) technique. In this method, image signals from the computer activate a laser scanning head to draw desired images directly on a printing plate.

Examples of this type of plate making system were developed by the inventors of the present invention and are disclosed in the Japanese patent applications published unexamined under Nos. 9-66595 and 9-334320. Those plate-making systems are formed from a plate feeder (plate feeding section), an exposure unit (electrostatic charge/drawing section), a plate discharging mechanism (plate discharging section) and development unit (heating, developing, rinsing, rubber coating, and drying), a bending mechanism (bender), and a printing plate storing device (stacker). These elements are arranged in the order specified and can make printing plates in different sizes ranging from one page of newspapers to several pages.

Large-size printing plates made by such plate-making systems save much time required to replace plates on the rotary press. That in turn raises the rate of operation, thereby printing more pages of the newspaper.

Meanwhile, newspaper report articles have been getting more and more locally diversified in content in recent years, and advertisements have also been diversified, with newspapers now being printed in many different forms and editions. That has resulted in increased printing of local editions, newspapers having local newspaper sections, that is, zoning newspapers, newspapers with pages suited for specially chosen readers (tailored newspapers), and newspapers with pages suited for specially chosen advertisers (targeted newspapers).

In printing such newspapers, it often happens that articles (that is, the contents) of a specific page in the newspaper has to be replaced. In conventional newspaper printing, a printing plate wound around the plate cylinder of the rotary press had four or two pages. For replacement, where a four-page plate was used, a whole plate having four pages had to be replaced with a new plate having four pages. If two plates, each for two pages, are mounted on the rotary press, one plate of the two had to be replaced with a new one.

To further illustrate, if the printing face B1 of a two-page printing plate P on the rotary press as shown in FIG. 9 is to be switched to printing face A1 or A3, or if the printing face B2 of a two page printing plate P is replaced with a printing face A1 or A3, four printing plates P as shown in FIG. 10 are prepared for any of those changes, so that the printing plate P mounted on the rotary press can be replaced by one of the four plates P shown in FIG. 10.

In the conventional plate-making systems, however, the maximum number of printing plates that can be produced by one operation of plate production is two two-page printing plates R To make the four printing plates P as shown in FIG. 10, the plate-making process has to be repeated twice, requiring a long time for producing replacement printing plates R Where a plurality of rotary presses are in operation, the number of printing plates P to be replaced will inevitably increase. That means that many new replacements have to be prepared. Thus the time and cost required for making replacement printing plates P have become a still more significant problem.

SUMMARY OF THE INVENTION

The present invention addresses those problems. It is a primary object of the present invention to provide a plate-making system that can make replacement printing plates efficiently and economically when changes are to be effected on a part of the printing faces of the plates mounted on the cylinder of the rotary press.

To achieve the foregoing object, the present invention as claimed in claim 1 provides a system 1 for making printing plates for newspaper printing wherein a plate feeder 2, an exposure unit 3, and a developer 5 are linearly arranged and the exposure unit 3 may directly draw images on the printing faces of a plate material 12 in accordance with image drawing signals from a computer to make a printing plate P large enough for at least several pages, wherein there are provided on the downstream side of the developer 5: a borer 7 for making positioning notches 12*a* and positioning holes 12*b* in the plate material 12 (for several pages of newspaper) as discharged from the developer 5; a cutter 8 for cutting the plate material 12 (for several pages of newspaper) from the borer 7 into several pieces of plate material 12', each the size of one page of newspaper; a first bender for forming bends 12*c* for mounting the printing plate on the rotary press—in the plate material 12 (for several pages of newspaper) which has not been cut by the cutter 8 after bored by the borer 7; and a second bender for forming bends 12*c* for mounting the plate on the rotary press in several one page pieces of plate material 12' obtained by cutting plate material 12 by the cutter 8 after boring by the borer 7.

The present invention as claimed in claim 2 has a direction changer installed between the developer 5 and the borer 7 to change the direction of the plate material 12 coming from the developer 5 and send the plate material 12 to the borer 7.

The present invention as claimed in claim 3 is provided with a plurality of second benders 10 near the cutter 8 so that several pieces of plate material 12' cut in the size of one page of newspaper are distributed to the several benders 10 for bending.

The present invention as claimed in claim 4 has a stacker 11 installed on the downstream side of the first bender 9 and a second bender 10 to pile up and store the prepared printing plates P, P'.

DESCRIPTION OF THE PREFERRED EMBODIMENTS

Embodiments of the present invention will now be described in detail in conjunction with reference to the drawings.

Embodiment 1

Figure 1:
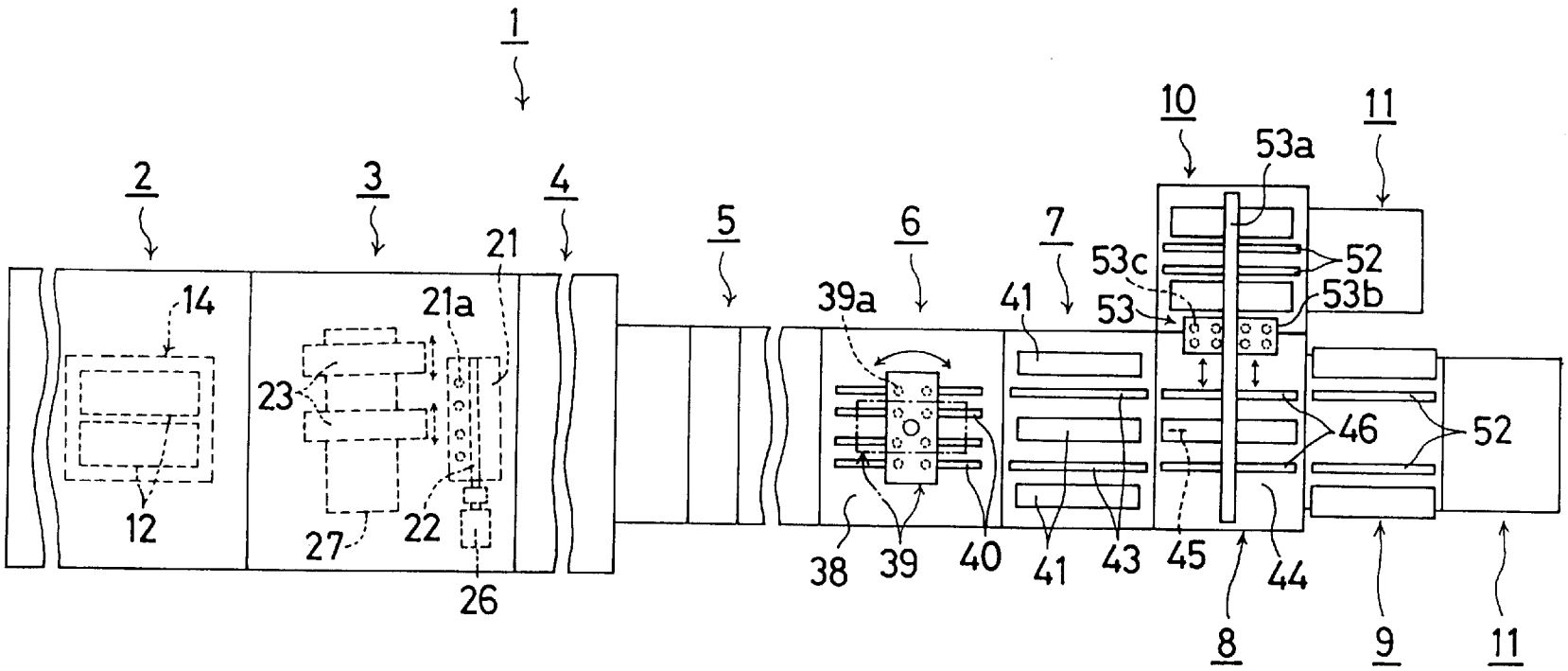
FIG. 1 is a schematic plan view of a system for making printing plates for newspaper embodying the present invention.

FIG. 1 is a schematic plan view of a system 1 for making printing plates for newspaper, by the CTP technique, embodying the present invention. The system 1 for making printing plates for newspaper includes plate feeder 2, exposure unit 3, plate discharger 4, developer 5, direction changer 6, borer 7, cutter 8, first bender 9, second bender 10 and stacker 11. This system 1 can make in one process run two pieces of printing plate P, each the size of two pages of newspaper, from two pieces of plate material 12, each having the size of two pages of newspaper arranged in series, or four pieces of printing plate P', each the size of one page of newspaper, from two pieces of plate material 12, each the size of two pages of newspaper.

To illustrate, two printing plates P, P, each the size of two pages of newspaper, can be made simultaneously in the plate-making system 1. Two unexposed plate materials 12, 12, each the size of two pages of newspaper, are supplied by the plate feeder 2 to the exposure unit 3 for image drawing. The two plate materials 12, 12 are then sent by the plate discharger 4 to the developer 5 for development. After that, the plates 12, 12 are turned by the direction changer 6 and sent to the borer 7 where positioning notches 12*a* and holes 12*b* are formed in the two plate materials 12, 12. The two plate materials 12, 12 are then referred to the first bender 9 without being cut where the plate materials are bent to form a bend 12*c* for mounting the plate on the cylinder of the rotary press (not shown). That way, two printing plates P, P, each the size of two pages of newspaper are made simultaneously.

Four printing plates P' . . . can be prepared this way. Two plate materials 12, 12 pass through the exposure unit 3, plate discharger 4, developer 5, direction changer 6, and borer 7 and are further supplied to the cutter 8 where the two plate materials 12 are each cut in the traverse direction at the center in two pieces. The four plates 12' . . . thus obtained and each having the size of one page of newspaper are then sent to the second bender 10 where the plates are each bent to form a bend 12*c* for mounting the plate on the cylinder of the rotary press, thereby simultaneously producing four printing plates P' each having the size of one page of a newspaper.

The plate material that is used here is what is called high-sensitive photopolymer plate made by coating an aluminum substrate with a highly sensitive photopolymer. These plates 12 . . . as supplied are packed in a state in which the plates 12 are piled up one upon another with a piece of protective paper between them to protect the plate surface (not shown).

It is also noted that the apparatus such as the plate feeder 2, exposure unit 3, plate discharger 4, developer 5, direction changer 6, borer 7, cutter 8, first bender 9, and second bender 10 are automatically controlled according to preset signals from a control system (not shown) such as a computer.

The plate feeder 2 is designed to simultaneously feed two unexposed plate materials 12, 12, each the size of two pages of newspaper linked longitudinally in series, to the exposure unit 3.

Figure 3:
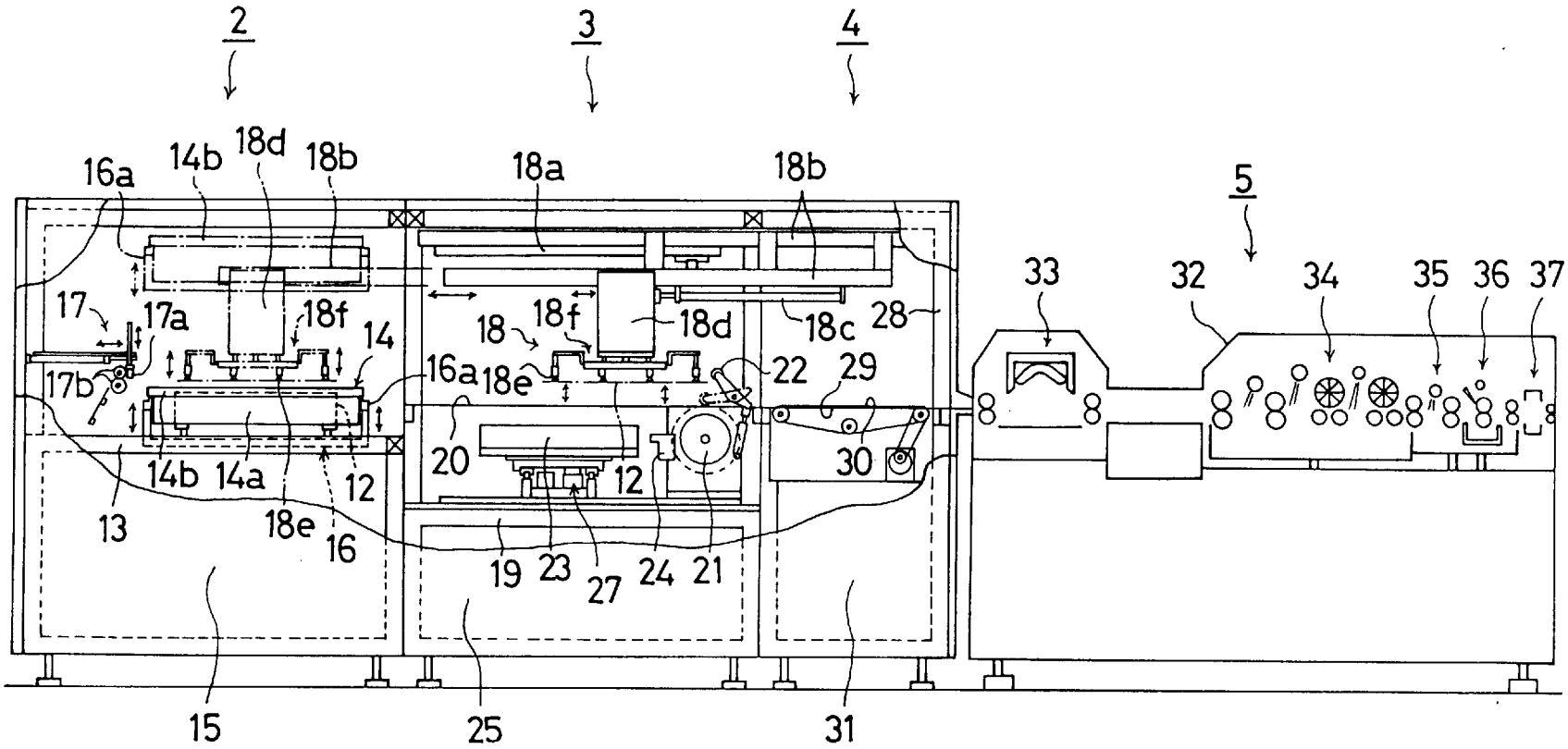
FIG. 3 is a schematic side and partly sectional view of the system for making printing plates for newspaper with the plate feeder, exposure unit, plate discharger and developer.
Figure 4:
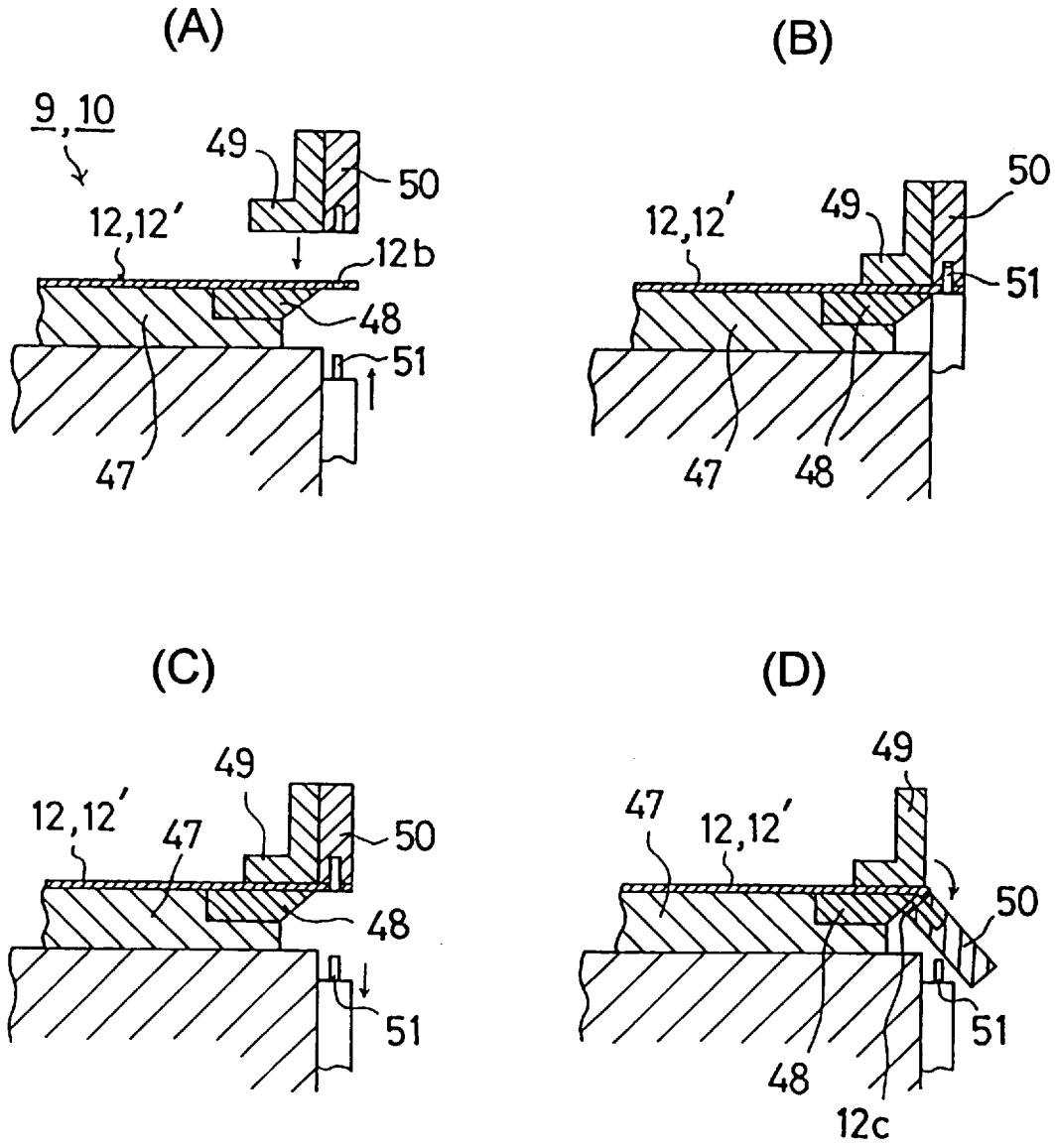
FIGS. 4(A)–4(D) show the first bender and the second bender in the system for making printing plates for newspaper, in order to explain the operation thereof.

The plate feeder 2 comprises, as shown in FIG. 3: a frame 13; a dark box 14 with an openable lid 14*b* carried on the frame 13 and containing unexposed plate materials 12; a light-shielding metal cover 15 covering the whole of the frame 13 and having a door through which the dark box 14 is moved in and out; a lid closing mechanism provided on the frame 13 to open and close the lid 14*b* of the dark box 14; a protective paper remover 17 provided on the frame 13 to take out of the dark box 14 the plate-protective paper sandwiched between the plate materials 12, 12 in the dark box 14; and a plate material carrier 18 provided on the side of the exposure unit 3 to suck and carry two plates 12, 12 out of the dark box 14 to the exposure unit 3 at a time.

The plate feeder 2 operates this way: When the door of the light-shielding cover 15 is closed with the dark box 14 placed on the frame 13, the lid opening device 16 is actuated to leave the dark box 14 open and then the protective paper remover 17 will work to take out of the dark box 14 the plate-protective interleaving paper between the plates 12, 12 in the dark box 14. Then, the plate material carrier 18 is activated to suck and carry two plate materials out of the dark box 14 to the exposure unit 3.

The dark box 14, as shown in FIGS. 1 and 3, is made up of a box-shaped metal body 14*a* opened upward and storing piles of unexposed plate materials 12 placed side by side, and a metal lid 14*b* capable of opening and closing for covering the opening of the body 14*a*. The dark box is so designed that when the lid 14*b* is put on the body 14*a*, the lid 14 and the body 14*a* are fitted into each other so closely as to completely shield the dark box 14 from light.

The lid closing mechanism 16 is formed out of a lifting body 16*a* arranged around dark box 14 on the frame 13, allowed to go up and down, and engageable with the outer periphery of lid 14*b* and a drive system to lift up and down lifting body 16*a*. The lid closing 16 operates this way: when the lifting body 16*a* engaged with the outer periphery of lid 14*b* is lifted, the lifting body 16*a* as indicated by a line including dots in FIG. 3 lifts the lid 14*b* to open dark box 14. Conversely, if the lifting body 16*a* is lowered, the lid 14*b* is placed on body 14*a*, closing the dark box 14 as indicated by a solid line in FIG. 3.

The protective paper remover 17 is made up of, as shown in FIG. 3, a plurality of vacuum-type suction cups 17*a* movable in the horizontal and vertical directions to suck and carry out of the dark box 14 the protective paper sandwiched between the plate materials 12 and 12 in the dark box 14 and a pair of paper discharging rollers 17*b* installed near the dark box 14 to discharge the paper conveyed by the suction cups 17*a*. The protective paper remover 17 is so designed that the protective paper on the unexposed plate material 12 in the dark box 14 is sucked up and moved to a position near the protective paper discharging rollers 17*b*, 17*b*, where part of the paper is engaged between the rotating rollers 17*b* and 17*b* so that the paper may be discharged out of the dark box 14. The protective paper carried out of the dark box 14 is discharged into a protective paper receiving bag (not shown) under protective paper remover 17.

The plate material carrier 18 comprises, as shown in FIG. 3, a two-stage expansion rail 18*b* which is provided at the ceiling portion of the space inside the exposure unit 3 and the plate discharger 4 and which is expanded and contracted by a fluid pressure cylinder 18*a*, a support frame 18*d* which is supported by the expansion rail 18*b* and allowed to run along the expansion rail 18*b* by the fluid pressure cylinder 18*c*, and a header 18*f* which is mounted on the support frame 18*d* by means of a fluid pressure cylinder (not shown), allowed to move up and down and provided with a plurality of vacuum rubber suction cups 18*e* for holding the plate materials 12 in the dark 14. The plate material carrier 18 operates this way: as the lid 14*b* of the dark box 14 is opened and the protective paper is removed, the expansion rail 18*b* stretches from the exposure unit 3 to the plate feeder 2 and the frame 18*d* moves to a position over the dark box 14. Then the header 18*f* moves down with the suction cups 18*e* sucking and holding a plate material 12 in the dark box 14. The header 18*f* rises to raise two plate materials 12, 12 stored side by side in the body 14*a* of the dark box 14. In this state, the expansion rail 18*b* retracts into the exposure unit 3 and at the same time the support frame 18*d* moves to the exposure unit 3. Finally, the header 18*f* goes down to place the plate materials 12, 12 on the table of the exposure unit 3. Two plate materials 12, 12, each the size of two pages of newspaper, are fed to the exposure unit 3 simultaneously.

The exposure unit 3 is mounted adjacent to and on the downstream side of the plate feeder 2 and exposes simultaneously two plate materials 12, 12, each the size of two pages of newspaper, fed by the plate feeder 2.

To further illustrate, the exposure unit 3 is formed out of, as shown in FIGS. 1 and 3, a frame 19 provided adjacent to and downstream of the plate feeder 2. The frame 19 is provided with table 20, exposure cylinder 21, plate winding roller 22, two laser scanning heads 23, and two cameras 24 for measurement of laser beams and other elements. The whole of the frame 19 is covered with a light-shielding metal cover 25 provided with a door that can open and close.

The exposure unit 3 operates this way. Image drawing signals (digitized signals) for plate making from a computer (not shown) are sent to each laser scanning head 23 by way of a image drawing controller (not shown). And laser scanning is effected on the printing face of a high-sensitive photopolymer plate according to the image drawing signals. Thus, signal images are drawn in the form of latent images on the plate 12.

The exposure cylinder 21 is driven to rotate by a servo motor 26. On the outside surface are provided vacuum suction holes 21*a* which vacuum suck and hold the plate material on the surface of the exposure cylinder 21 and positioning stoppers (not shown) that position the upper end when the plate material 12 is mounted. Furthermore, the laser scanning heads 23 expose images directly on the plate material 12 according to image drawing signals from the computer. The laser scanning heads 23 can be moved by the moving mechanism 27 in parallel with the axis of the exposure cylinder 21.

The exposure unit 3 is of the same construction as that disclosed in the Japanese patent application laid open unexamined under No. 9-334320.

Thus, the two plate materials fed to the table 20 of the exposure unit 3 by the plate feeder 2 are positioned by the stoppers wherein the front end is put and held on the outside surface of the exposure cylinder 21 by the vacuum suction holes 21*a* and is wound on the outside surface of the exposure cylinder 21 as the exposure cylinder 21 and the plate winding roller 22 rotate in the winding direction. Then, the rear end is put and held on the outside surface of the exposure cylinder 21 by the vacuum suction holes 21*a*.

When the two plate materials 12, 12 have been wound around the outside surface of the exposure cylinder 21, the servo motor 26 rotates the exposure cylinder 21 in a specific direction. At the same time, two laser scanning heads 23, 23 are moved in a specific direction by a moving mechanism 27, and image drawing (exposure) is done simultaneously on the two plates 12, 12 by the two laser scanning heads 23, 23.

When image drawing is completed on the two plates 12, the front end of the plate 12 held by the vacuum suction holes 21*a* is released, and the exposure cylinder 21 and the plate winding roller 22 rotate in a specific direction. By this action, the two plate materials 12, 12 wound around the exposure cylinder 21 are removed and carried away to the plate discharger 4.

The plate discharger 4 is provided with, as shown in FIG. 3, a table 29, a belt conveyer 30 and other elements on a frame 28, which is installed downstream of and adjacent to the exposure unit 3. The whole of the frame 28 is covered with a light-shielding metal cover 31 provided with a door that can be opened and closed. The plate discharger 4 is constructed so that the two exposed plate materials 12, 12 sent out from the exposure unit 3 are received by the table 29. The plate materials 12, 12 on the table 29 are referred to the developer 5 which follows by the belt conveyer 30.

The developer 5 has within a case 32 a heater 33, a developer 34, a rinser 35, a rubber coater 36, and a dryer 37, as shown in FIG. 3. In this unit 5, the latent image formed in the exposure unit 3 is heated by the heater 33 and fixed on the printing face on the plate and then the high sensitive photopolymer layer other than the fixed images is removed with alkaline solution to form a printing face. The plate material is then rinsed in the rinser 35 and put to protective treatment such as coating with rubber in the rubber coater 36.

The direction changer 6 is mounted downstream of and adjacent to the developer 5. This direction changer 6 is to change the position of the plate material 12 so that the apparatuses which follow such as the borer 7 and cutter 8 may receive the plate material 12 properly.

Figure 2:
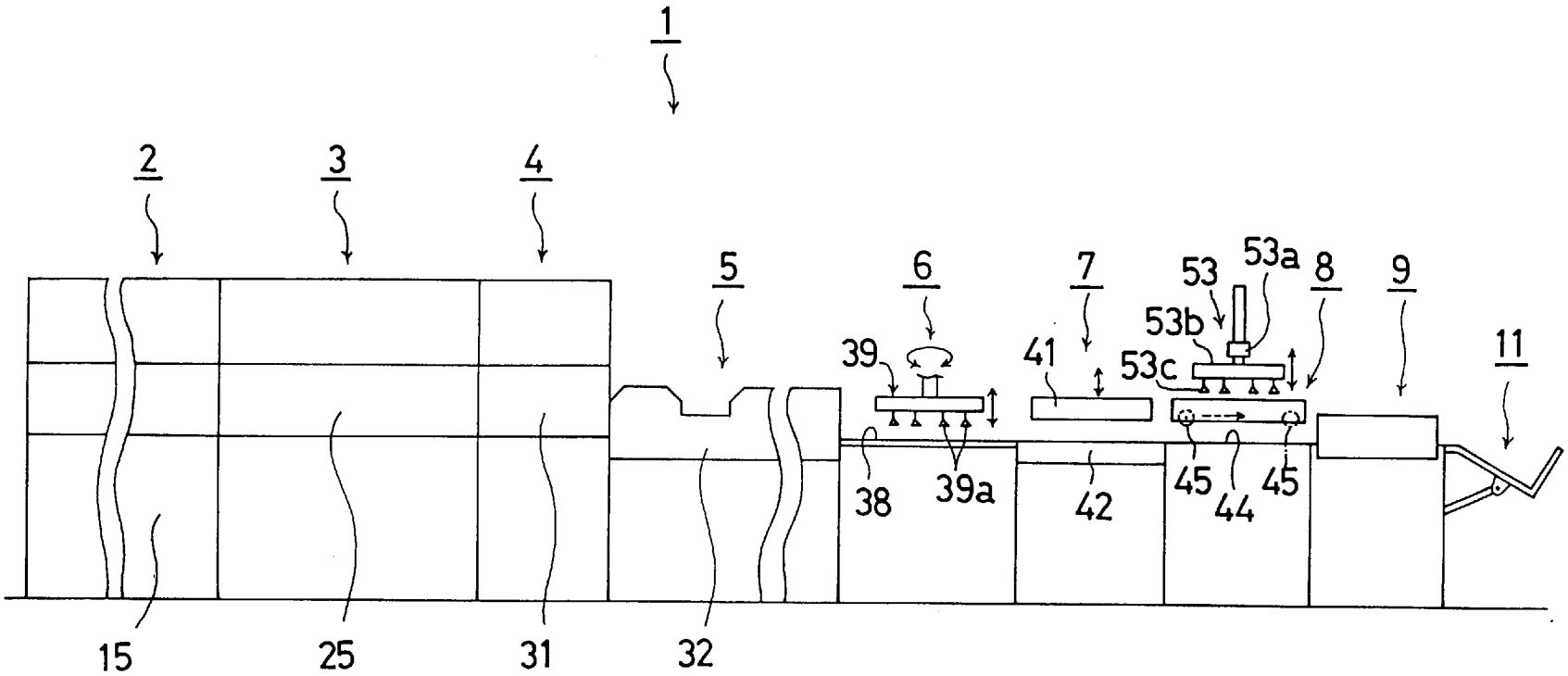
FIG. 2 is a schematic side view of the system for making printing plates for newspaper.

To further illustrate, the direction changer 6 receives the two plate materials 12, 12 as discharged from the developer 5, and changes the direction of the plates by turning them 90 degrees before sending them out to the following borer 7. As shown in FIGS. 1 and 2, the direction changer 6 is formed out of a table 38 to receive the plate materials 12, 12 from the developer 5, a rotator 39 mounted over the table 38, movable up and down and rotatable, and provided with vacuum suction cups 39*a* which hold on two plate materials 12, 12 on the table 38 at a time and change the direction thereof, and a belt conveyer 40 provided on the table 38 to carry to the following borer 7 the turned two plate materials 12, 12.

The borer 7, which is provided downstream of and adjacent to the direction changer 6, is to form in the two plate materials 12, 12, sent in from the direction changer 6, positioning notches 12*a* used to position the printing plate on the rotary press. The borer 7 is also to make holes 12*b* used to position the plates on the first bender 9 and the second bender 10.

The borer 7 as shown FIGS. 1 and 2 is a press machine with a plurality of punches (not shown) which is equipped with three vertically movable upper members 41 disposed side by side and positioned opposite to the two ends and the center of the plate materials, and a lower member 42 provided with a plurality of holes (not shown) which fit with the punches of the upper members 41. In operation, the respective upper members 41 are moved up and down by a specific distance with the punches inserted into the corresponding holes on the lower member 42. This way, positioning notches 12*a* and holes 12*b* are formed at specific positions in the two plate materials 12. On the lower member 42 of the borer 7 are provided belt conveyers 43 which carry the two plate materials 12 to the cutter 8 which follows.

The positioning notches 12*a* are formed at such places that positioning protrusions (not shown) provided on the plate cylinder of the rotary press may engage with those positioning notches 12*a* when the completed printing plate is mounted on the rotary press. That is, the positioning notches 12*a* are to put the printing plate in place on the plate cylinder and at the same time to block the printing plate from moving in the axial direction of the plate cylinder.

The positioning holes 12*b* are formed at such places that the positioning pins 51 provided on the benders 9, 10 may engage with the corresponding holes 12*b* when the two ends of the plate materials 12 are bent by the first bender 9 and the second bender 10. In other words, the holes 12*b* are for the plate materials 12, 12 to be placed in a predetermined position on the benders 9, 10.

Figure 5:
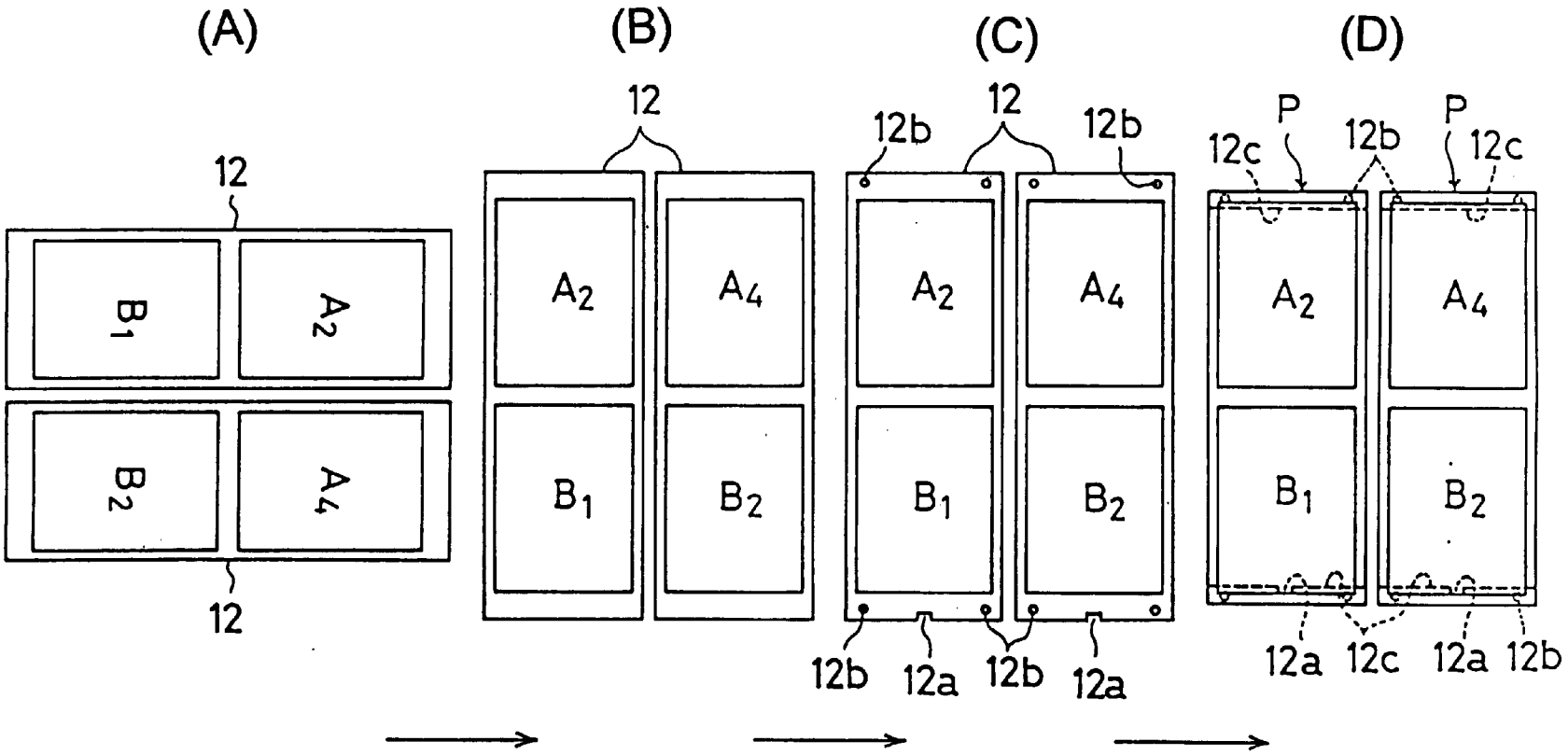
FIGS. 5(A)–5(D) constitute a diagram showing the process of making two printing plates each for two pages of newspaper from two plate materials each for two pages of newspaper.
Figure 7:
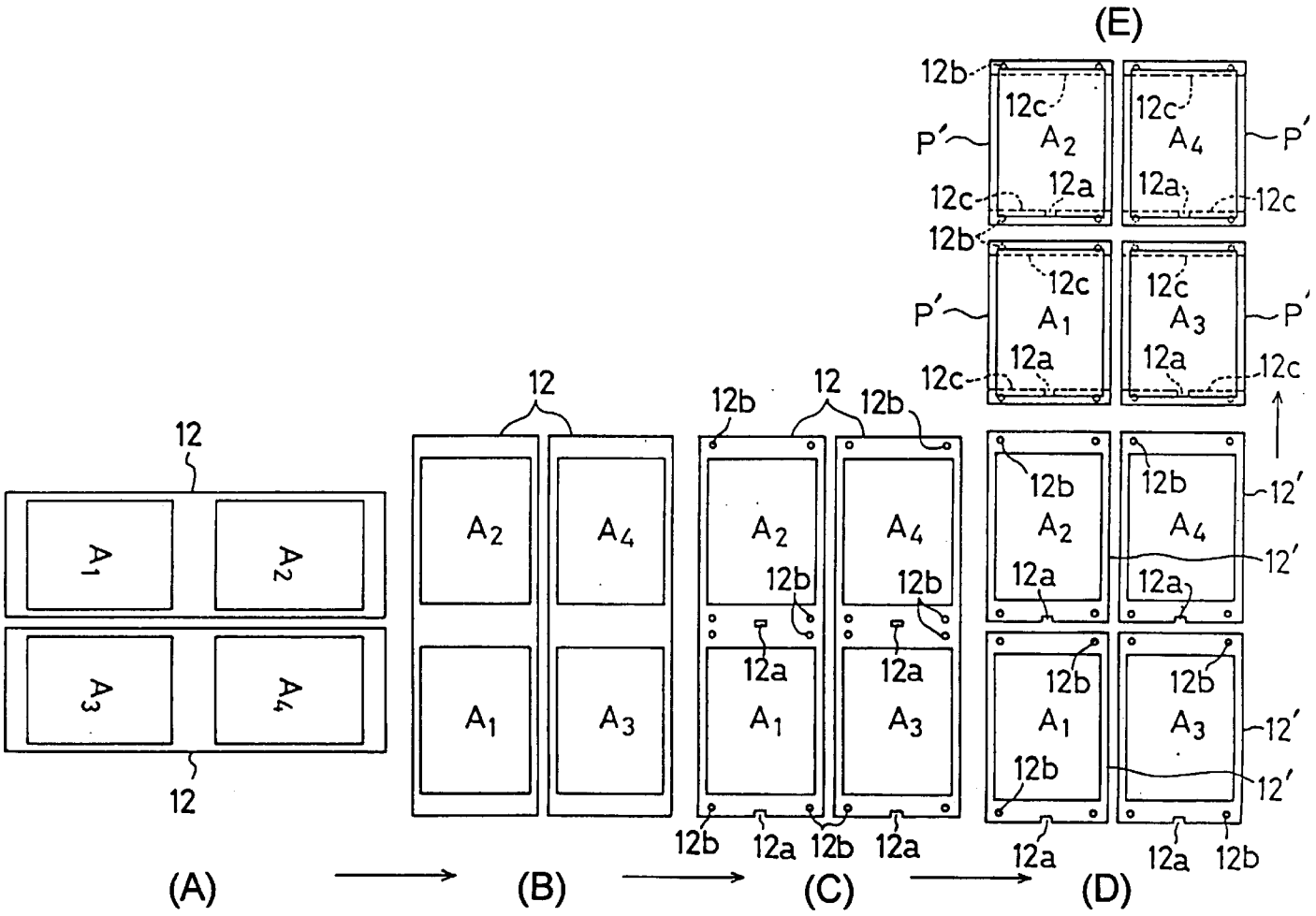
FIGS. 7(A)–7(E) constitute a diagram showing the process of making four printing plates, each the size of one page of newspaper, from two plate materials, each the size of two pages of newspaper.

Thus, the borer 7 makes notches 12*a* and holes 12*b* in the center and at the two ends of the two plate materials 12, 12 as shown in FIG. 7 by moving up and down the three upper borer members 41 in case the two plate materials 12 are to be cut along the width-wise median line into four plate materials 12' . . . On the other hand, in case there is no need to cut the two plate materials 12 in half by the cutter 8, only the two upper members 41 at the two ends move up and down to make notches 12*a* and holes 12*b* at the two ends as shown in FIG. 5.

Square notches 12*a* made in the center of the plates 12, 12 become opened notches 12*a* when the plates 12, 12 are cut along the median line by the cutter 8. The cutter 8, mounted downstream of and adjacent to the border 7, cuts in half the two plate materials 12, 12 sent from the borer 7 along the traverse median line to produce four plate materials 12'.

The cutter 8 is equipped with, as shown in FIGS. 1 and 2, a loading platform 44 to receive and carry the two plate materials 12, 12 from the borer 7 and rotary blades 45 provided over the loading platform 44, movable vertically and allowed to run in the traverse direction of the plate 12. The rotary blades rotate and run to cut the plate materials 12.

On the loading platform 44 of the cutter 8 are provided belt conveyers 46 to send out the two plate materials 12, 12 to the following bender 9 in case the two plate materials 12, 12 are not cut in half. The cutter 8 is not actuated when there is no need to cut the two oblong plate materials, each the size of two pages of newspaper. The belt conveyers 46 alone work to send out the two oblong plates 12, 12 to the first bender 9.

The first bender 9 is installed downstream of and adjacent to the cutter 8 as shown in FIGS. 1 and 2. The first bender 9 forms bends 12*c* used when mounting the two uncut oblong plates 12, 12 on the plate cylinder of the rotary press. The second bender 10 is installed close to and on the lateral side of the cutter 8 as shown in FIG. 1. The second bender 10 forms bends 12*c* in four plate materials 12' . . . , each the size of one page of newspaper, which were produced by cutting in half the plates by the cutter 8. The bends 12*c* are used when the plates are mounted on the plate cylinder of the rotary press.

The benders 9, 10 comprises, as shown in FIGS. 4(A) to 4(D): a loading platform 47 on which the plate material 12 is put and which is somewhat longer than the plate material 12; receiving blades 48 provided at the two ends of the loading platform 47; a plate press 49 movable vertically in relation to the loading platform 47 to clamp the plate material on the loading platform 47; a bending movable blade 50 which is provided on the plate press 49 and is pivotable to bend downward along the receiving blade 48 the edge portion of the plate material 12 protruding beyond the receiving blade 48, which plate material is pressed and clamped on the loading platform 47 by the plate press 49; and vertically movable positioning pins 51 which are provided outside of the receiving blade 48 and are to be fitted into the positioning holes 12*b* in the plate material 12. By those bends 9, 10, the two ends of the plate material 12 are bent until a roughly V-shaped bend 12*c* is formed.

On the loading platform 47 of the first and second benders 9 and 10 are provided belt conveyers 52 to send out to the following stacker 11 the plate materials 12, 12' with bends 12*c* formed. The benders 9, 10 are of the same construction as those disclosed in the Japanese utility model application laid open under No. 53-159703.

Above the cutter 8 and the second bender 10 is a moving means for transferring to the second bender 10 each one or two of the four plate materials 12' . . . , each the size of one page of newspaper, from the cutter 8. The moving means 53 includes, as shown in FIGS. 1 and 2, a guide rail 53*a* provided above the cutter 8 and the second bender 10, a mover 53*b* mounted on the guide 53*a*, movable up and down and allowed to run along the guide rail 53*a*, and vacuum suction cups 53*c* that are mounted on the mover 53*b* and hold the plate materials 12' on the platform of the cutter 8 one by one or two by two. That is, it is arranged so that the plate materials 12' on the loading platform 44 of the cutter 8 can be transferred to the loading platform of the second bender 10 one by one or two by two.

The stackers 11, each provided downstream of and adjacent to the first bender 9 and the second bender 10, store piles of the plate materials 12, 12' (printing plates P, P) conveyed from the benders 9, 10.

There will now be described examples of making an oblong printing plate P, the size of two pages of newspaper, having printing face B1 and A2, and another oblong printing plate P, the size of two pages of newspaper, having printing face B2 and A4.

A pack of oblong unexposed plate materials 12, each the size of two pages of newspaper, is unpacked in a dark room (not shown) provided separately from the plate-making system 1. In this dark room, piles of the plate materials 12 are stored side by side in the dark box. The dark box is then loaded on a handcart-type carrier (not shown) and moved through the daylight room to the plate feeder 2 of the plate-making system 1. The dark boxes 14 containing the plates are loaded on the frame 13 of the plate feeder 2.

When the door of the light-shielding cover 15 is closed with the dark box 14 placed on the frame 13 of the plate feeder 2, the door closing mechanism 16 is actuated to leave the dark box 14 opened and the protective paper remover 17 is actuated to remove out of the dark box 14 the protective paper protecting the printing face of plate materials 12 in the dark box 14 and discharge the same into a protective paper receiving bag (not shown). Then, the plate material carrier 18 works to suck and transfer two plate materials 12, 12 from the dark box 14 to the table 20 of the exposure unit 3.

The two oblong plate materials 12, 12 carried to the exposure unit 3 are simultaneously put to image drawing treatment by the direct laser image drawing method. The exposed two plate materials 12, 12 are discharged by the plate discharger 4 from the exposure unit 3 to the developer 5 for development. That is, passing through the exposure unit 3 and the developer 5, the two plate materials 12, 12 of the size of two pages of newspaper are formed—one plate having printing faces B1 and A2 and the other having printing faces B2 and A4. See FIG. 5(A).

The two oblong plate materials 12, 12 discharged from the developer 5 are received by the direction changer 6 and held and turned 90 degrees by the rotator 39 and then sent out to the borer 7 by the belt conveyer 40 provided on the table 38. See FIG. 5(B).

The two plate materials 12, 12 sent to the borer 7 are bored. Thus formed are notches 12*a* at one end for positioning the plate 12 on the rotary press and also positioning holes 12*b* at the two ends for positioning the plate on the first bender 9. After that, the two plate materials 12, 12 are sent out to the cutter 8 by the belt conveyer 43 provided at the borer 7. See FIG. 5(C).

The two plate materials 12, 12 sent to the cutter 8 are not cut but forwarded to the first bender 9 by the belt conveyer 46 provided at the cutter 8. At the bender 9, the two ends of each plate 12 are bent to form bends 12*c* for mounting the plate on the plate cylinder of the rotary press. See FIG. 5(D).

In this way, one obtains a so-called printing plate P.

Printing plates, each the size of two pages of newspaper, are piled up and stored in the stacker 11 as they are sent in from the first bender 9 by the belt conveyer 52. That way, a printing plate P of the size of two pages of newspaper having printing faces B1 and A2 and another printing plate P of the same size with printing faces B2 and A4 are made by the plate-making system 1. Those plates P are mounted on the plate cylinder of the rotary press for the printing of newspaper.

Figure 6:
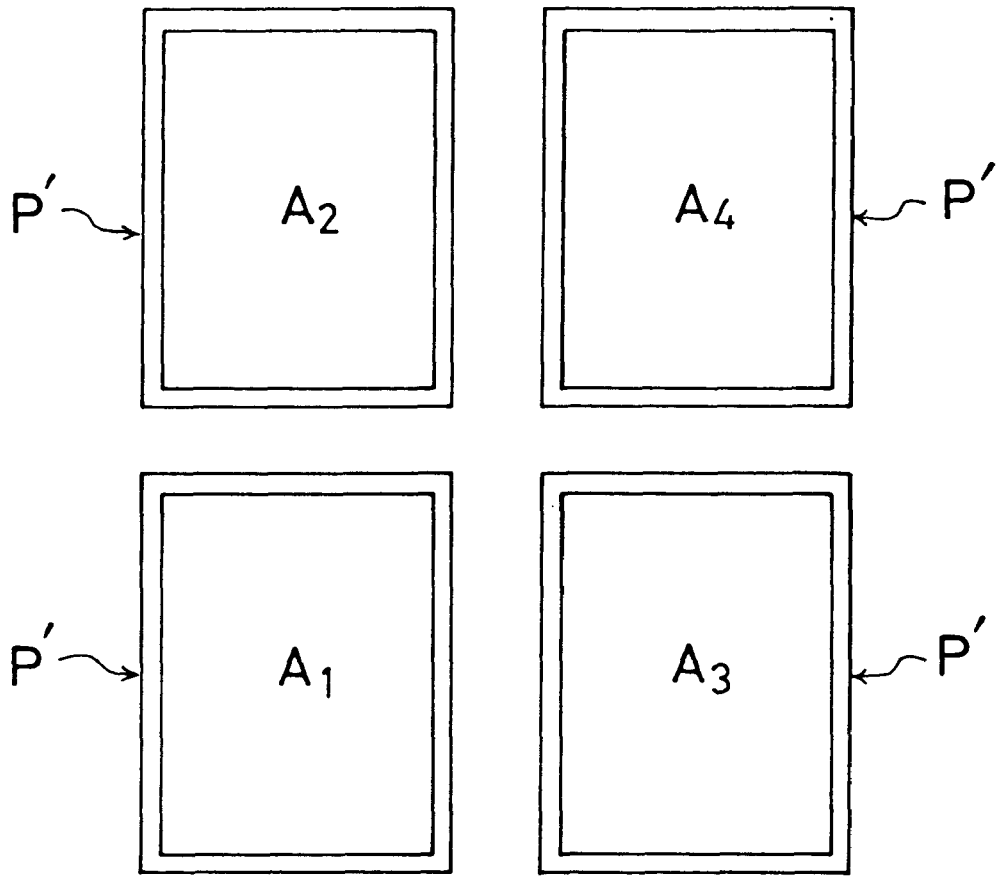
FIG. 6 is a plan view of four printing plates, each the size of one page of newspaper.

Meanwhile, it can happen that printing face B1 or B2 on the printing plate P (FIG. 5(D)) to be mounted on the plate cylinder of the rotary press has to be replaced with printing face A1 or A2. In such a case, four one-page size printing plates P' . . . having printing faces A1, A2, A3, and A4 as shown in FIG. 6 are made by the plate-making system 1 wherein the printing plate P mounted on the plate cylinder of the rotary press is replaced by one page size printing plates P'.

The four printing plates P' . . . or the four separate one-page printing faces—A1, A2, A3, and A4—are prepared by the plate-making system 1 this way. First, two oblong plate materials 12, 12, each the size of two pages of newspaper, one with printing faces A1 and A2 and the other with printing faces A3 and A4, are produced. See FIG. 7(A). This process involves the plate feeder 2, exposure unit 3 and developer 5 as in making the aforesaid printing plate P.

The plate material 12 with printing faces A1 and A2 and the plate material 12 with A3 and A4 are received by the direction changer 6 as they are discharged from the developer 5 and turned 90 degrees by the rotator 39. In that state, the plates are sent out to the borer 7 by the belt conveyer 40 provided on the table 38. See FIG. 7(B).

The two plate materials 12, 12 that are sent to the borer 7 are bored. Thus formed are notches 12*a* at one end and in the center for positioning the plate 12 on the rotary press and also positioning holes 12*b* at the two ends and in the center for positioning the plate on the second bender 10. After boring, the two plate materials 12, 12 are sent out to the cutter 8 by the belt conveyer 43 provided at the borer 7. See FIG. 7(C).

The two plate materials 12, 12 which have been sent to the cutter 8 are cut along the traverse median line by the rotary blade 45 to give four separate plate materials 12' . . . , each with one of four printing faces—A1, A2, A3 and A4. See FIG. 7(D).

The separated four plate materials 12' are then sent by the mover 53 one by one or two by two to the bender 10, where the two ends are bent to form bends 12C for mounting the plate on the plate cylinder of the rotary press. See FIG. 7(E).

That way, four separate one-page printing plates P' . . . are prepared.

Separate one-page printing plates P' . . . are piled up and stored in the stacker 11 as they are sent out on belt conveyer 52 from second bender 10.

By this plate-making system 1, as set forth above, it is possible to make, in one run of the process, to make four separate one-page printing plates P' . . . each with one of four printing faces—A1, A2, A3 and A4. These printing plates P' . . . are used for printing as replacement of the printing plate P mounted on the plate cylinder of the rotary press.

The prior art plate-making system had to conduct the plate-making process a plurality of times to prepare replacement printing plates P (oblong two-page plates) when a specific page on the printing plate P mounted on the plate cylinder of the rotary press was to be replaced with another. The plate-making system of the present invention can make, in one run of the process, replacement printing plate P' . . . with great efficiency.

Embodiment 2

Figure 8:
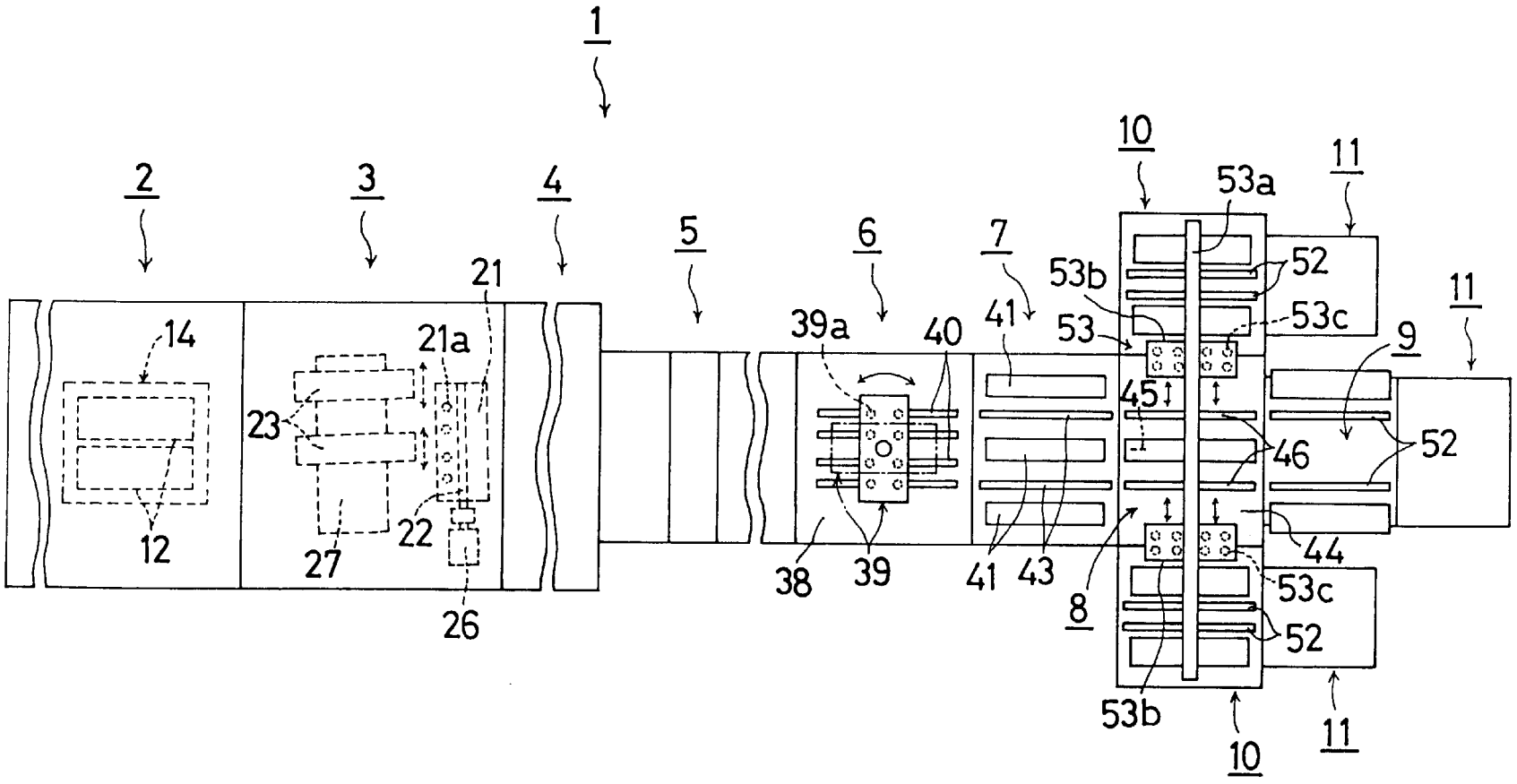
FIG. 8 is a schematic plan view of a system for making printing plates for newspaper according to another embodiment of the present invention.
Figure 9:
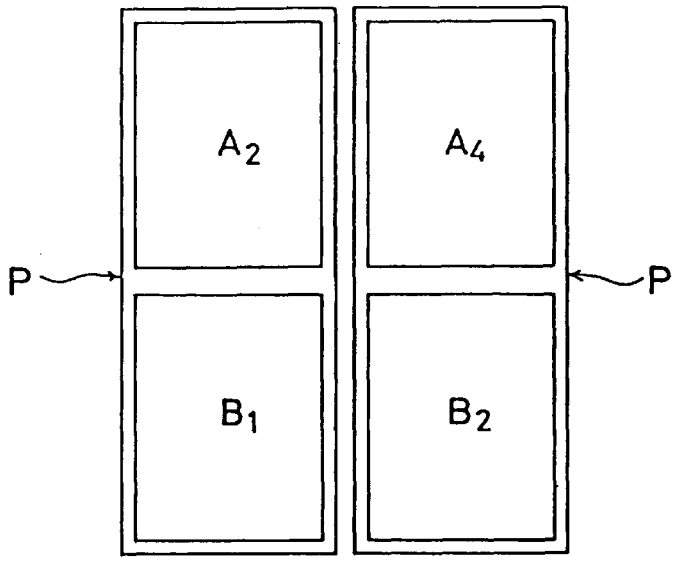
FIG. 9 is a plan view of two printing plates, each the size of two pages of newspaper.
Figure 10:
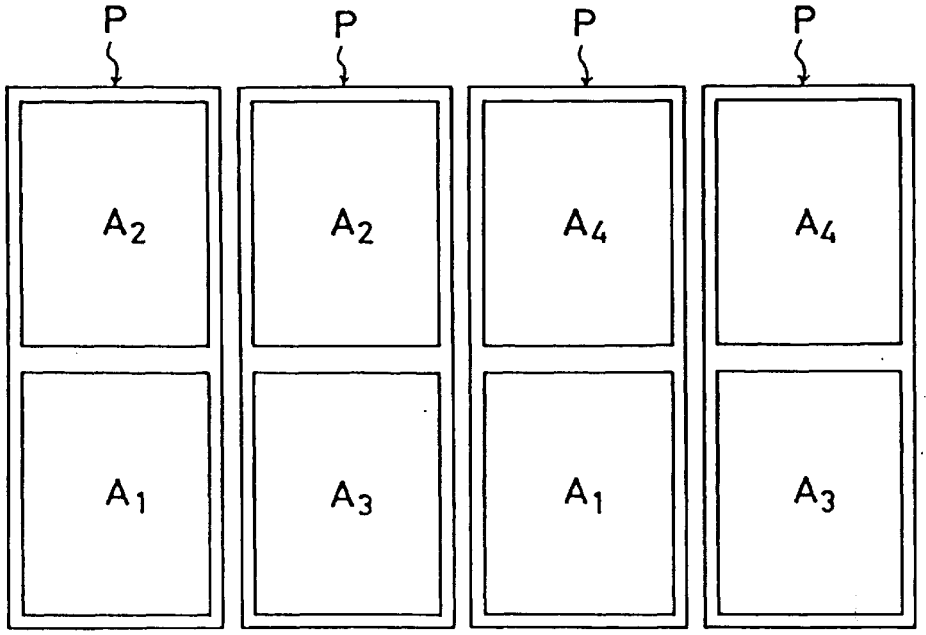
FIG. 10 is a plan view of four printing plates, each the size of two pages of newspaper.

FIG. 8 is a schematic plan view showing of a system for making printing plates for newspaper by the CTP technique according to another embodiment of the present invention. In this plate-making system, there is provided the second bender 10 on each lateral side of the cutter 8 and, in addition, the stacker 11 downstream of each second bender 10 so that four separate one-page printing plate materials 12' . . . from the cutter 8 are separated and supplied to the two units of the second bender 10 for bending.

Except for that, this embodiment is of the same arrangement as the plate-making system 1 illustrated in FIGS. 1 to 4, including the same components: plate feeder 2, exposure unit 3, plate discharger 4, developer 5, direction changer 6, borer 7, cutter 8, first bender 9, second bender 10, moving means 53 and stacker 11. The parts of this embodiment that are common with those of the system in FIGS. 1 to 4 are shown by the same reference numerals. No detailed description will be given.

In the plate-making system 1 of this embodiment of the present invention, it is possible to form bends 12*c* in the four separate printing plates 12' . . . by the two units of second bender 10. In other words, replacement printing plates P' can be prepared in a shorter time.

In the preceding embodiments, the plate material 12 is a highly sensitive photopolymer plate. In other embodiments of the present invention, other plates may be used, for instance, silver salt plates, silver salt+diazo hybrid plates, and heat-plate materials.

In the embodiments described above, two plate materials 12, 12, each the size of two pages of newspaper, are cut into four one-page printing plates P' . . . . In another embodiment, a four-page plate material (not shown) may be cut into four one-page printing plates P' . . . .

In the embodiments described above, the plate-making system 1 is a linear arrangement of plate feeder 2, exposure unit 3, plate discharger 4, developer 5, direction changer 6, borer 7, cutter 8 and first bender 9 with the second bender 10 placed on one side or two lateral sides of the cutter 8. That arrangement of the system components in the embodiments is not restrictive. Any arrangement or configuration may be adopted as long as the plate material 12 of the size of several pages of newspaper, can be processed and cut into one5 page printing plates P'.

It is also so arranged in the embodiments described above that a pack of unexposed plate materials 12 is unpacked in a dark room (not shown) provided in a place separated from the plate-making system 1 and that the dark box containing the unpacked plate materials 12 is forwarded by a carrier cart to the plate-making system 1 through a daylight room. In another embodiment, the dark box may be installed upstream of the plate-making system 1 so that the pack of unexposed plate materials 12 may be unpacked therein and sent to the plate feeder 2.

The plate feeder is not limited to the described construction. Any construction or configuration will do as long as the plate feeder can supply unexposed plate materials 12 to the exposure unit 3.

The direction changer 6 in the above embodiments comprises a rotator 39 equipped with suction cups 39*a* and a table 38 and so designed that the rotator 39 sucks and turns the plate material 12 on the table 38. In another embodiment, the direction changer 6 may comprise a turntable (not shown) which changes the direction of the plate material 12 and sends the same out to the borer 7 which follows.

In the aforesaid embodiments, the cutter is provided with a movable rotary blade 45 which rotates and runs to cut plate materials 12. In another embodiment, instead of the rotary blade 45, a linear blade (not shown) may be used which is moved up and down to cut the plate material 12.

As set forth above, the plate-making system as claimed in claim 1 is provided, on the downstream side of the developer, with: a borer for forming positioning notches and positioning holes in the plate material as the plate material is discharged from the developer; a cutter for cutting the plate material, the size of several pages of newspapers from the borer into several plate materials, each the size one page of newspaper; a first bender for forming bends, for mounting the plate on the rotary press, in the plate material having the size of several pages of newspaper, which has not been cut by the cutter; and a second bender for forming bends, for mounting the plate on the rotary press, in several one page size plate materials produced by cutting the plate material in the size of one page of newspaper by the cutter after the boring.

That facilitates replacement of a page or pages on the printing plate of the several page size on the rotary press. The prior art plate-making system had to conduct the plate-making process a plurality of times to prepare replacement printing plates P or oblong two-page plates. The plate-making system of the present invention can make, in one run of the process, four replacement printing plates, thus saving time and achieving great efficiency.

The plate-making system as claimed in claim 2 has a direction changer installed between the developer and the borer to change the direction or position of the plate material so as to make it easy for the plate material to be received and processed by the apparatuses which follow—the borer, the cutter, and the benders.

The present invention as claimed in claim 3 is provided with a plurality of units of the second bender near the cutter so that a plurality of plate materials cut in the size of one page of newspaper are distributed among the several benders for bending. In other words, a plurality of plate materials can be bent simultaneously, thus speeding up formation of bends and preparation of printing plate.

The plate-making system as claimed in claim 4 has a stacker installed on the downstream side of the first bender and the second bender 10 to pile up and store the prepared printing plates, which saves the trouble of sorting those pieces for easier handling.

What is claimed is:

1. A system for making printing plates for newspaper, said system comprising a linear arrangement of a plate feeder, an exposure unit, and a developer, wherein the exposure unit can directly form images on the printing faces of a plate material in accordance with image drawing signals from a computer to make a printing plate large enough for at least several pages, and wherein on the downstream side of the developer are provided:

a borer for forming positioning notches and positioning holes in the plate material—for several pages of newspaper—which has been discharged from the developer;

a cutter for cutting the plate material—for several pages of newspaper from the borer into several plate materials—each the size one page of newspaper;

a first bender for forming bends, for mounting the printing plate on a rotary press, in the plate material—for several pages of newspaper—which has not been cut by the cutter after being bored by the borer; and at least one second bender for forming bends, for mounting the plate material on the rotary press, in a plurality of one page size plate materials obtained by cutting the plate material by the cutter after boring by the borer.

2. The system for making printing plates for newspaper as defined in claim 1, which has a direction changer installed between the developer and the borer to change the direction of the plate material from the developer and send the plate material out to the borer.

3. The system for making printing plates for newspaper as defined in claim 1, wherein there are provided a plurality of second benders near the cutter so that several plate materials cut in the size of one page of newspaper are distributed among the several benders for bending.

4. The system for making printing plates for newspaper as defined in claim 1, wherein a stacker is installed, on the downstream side of the first bender and each of the second benders, to pile up and store the prepared printing plates.

* * * * *